US006270157B1

(12) United States Patent
Kapushinski

(10) Patent No.: US 6,270,157 B1
(45) Date of Patent: Aug. 7, 2001

(54) FLOPPY DESK

(76) Inventor: Stanley Joseph Kapushinski, R.R. 2 Box 560, Paxinos, PA (US) 17860

( * ) Notice: Subject to any disclaimer, the term of this patent is extended or adjusted under 35 U.S.C. 154(b) by 0 days.

(21) Appl. No.: 09/543,635

(22) Filed: Apr. 6, 2000

(51) Int. Cl.[7] ..... A47B 39/00

(52) U.S. Cl. ..... 297/170; 297/172; 297/188.21; 297/217.4

(58) Field of Search ..... 297/170, 171, 297/172, 188.01, 188.21, 217.4, 344.1, 423.25

(56) References Cited

U.S. PATENT DOCUMENTS

| | | | | |
|---|---|---|---|---|
| 5,697,668 | * | 12/1997 | Chao | 297/172 |
| 5,765,910 | * | 6/1998 | Larkin et al. | 297/172 |
| 6,039,392 | * | 3/2000 | Dencker | 297/172 |
| 6,102,476 | * | 8/2000 | May et al. | 297/217.4 X |

* cited by examiner

*Primary Examiner*—Laurie K. Cranmer

(57) ABSTRACT

The floppy desk is designed to interface with a modern personal computer system. It is anthropometrically sized for the average of the 95$^{th}$ percentile of males and females. The floppy desk consists of an upper assembly and a support base. The upper assembly is composed of a tubular frame, a seat, an adjustable back and head rest, a foot platform, a computer support and a single plane work surface for monitor, keyboard and mouse. The support base is composed of a welded tubular frame with integral brackets for the upper assembly pivot and the shock absorber. The most important feature of the floppy desk is that the entire upper assembly reclines relative to the support base and maintains the operator's relative position to the monitor, keyboard, and computer. Reclining is achieved by the offset weight of the operator as he or she takes the seated position. Afterwards, as the operator vacates the seat, the unbalanced computer component weights cause the upper assembly to return to its horizontal position. The recline angle being adjustable by means of an adjusting knob/stop located between the upper assembly and the support base. A shock absorber or gas spring is provided between the upper assembly and support base to dampen the recline and return motion. The entire structure is designed to be assembled with simple bolted connections.

19 Claims, 14 Drawing Sheets

FLOPPY DESK

BACKGROUND OF THE INVENTION

I. Field of Invention

The invention relates to computer furniture, and in particular a computer desk anthropometrically and economically designed for use with a modem personal computer system, referred to hereafter, as the floppy desk.

II. Pior Art

U.S. Pat. No. 371,168 issued Oct. 11, 1887, to Boss, discloses a desk having an angled work surface with a retractable seat that can be stowed within.

U.S. Pat. No. 784,604 issued Mar. 14, 1905, to Wall, discloses a chair and desk combination having multiple seats surrounding a central desk.

U.S. Pat. No. 2,024,045 issued Dec. 10, 1935, to Johnson, discloses a desk having dual swiveling and swinging chairs for user comfort.

U.S. Pat. No. 2,115,497 issued Apr. 26, 1938, to Mintz, discloses a combined desk and chair with a flip open work surface making use of the space within.

U.S. Pat. No. 2,375,696 issued May. 8, 1945, to Shick, discloses a combined music chair and stand with a horizontally pivoting seat.

U.S. Pat. No. 2,624,392 issued Jan. 6, 1953, to Bargen, discloses a school desk having an integral top and a vertically adjustable seat.

U.S. Pat. No. 2,725,095 issued Nov. 29, 1955, to Rodefeld, discloses a table and seat combination, having a vertically adjustable table and a horizontally pivoting seat to take advantage of available lighting.

U.S. Pat. No. 3,770,334 issued Nov. 6, 1973, to Weber, discloses a combination desk and chair having a hydraulic or pneumatic, vertically adjustable, work surface.

U.S. Pat. No. 4,779,922 issued Oct. 25, 1988, to Cooper, discloses a workstation supporting a computer monitor and keyboard on separate work surfaces, rockable about a horizontal axis.

U.S. Pat. No. 4,880,270 issued Oct. 14, 1989, to Cooper, discloses a workstation supporting a computer monitor and keyboard on separate work surfaces, the work surfaces attached to a coupled carriage that maintains the same spatial relationship between the chair and carriage.

U.S. Pat. No. 4,915,450 issued Apr. 10, 1990, to Cooper, discloses a workstation supporting a computer monitor and keyboard on separate work surfaces, rockable about a horizontal axis.

U.S. Pat. No. 5,056,864 issued Oct. 15, 1991, to Cooper, discloses a workstation supporting a computer monitor and keyboard on separate work surfaces, rockable about a horizontal axis.

U.S. Pat. No. 5,452,950 issued Sep. 26, 1995, to Crenshaw et al., discloses a computerized school desk with an imbedded computer and flat screen monitor inside.

U.S. Pat. No. 5,779,305 issued Jul. 14, 1998, to Hocking, discloses a workstation with two upright parallel stanchions supporting a computer, monitor, keyboard and printer.

U.S. Pat. No. 5,909,934 issued Jun. 8, 1999, to McGraw, discloses a combination seat and desk supported by an oblong base.

The disclosed inventions do not offer the unique, useful, and inventive features incorporated into the floppy desk. They are either too complex for simple manufacture or not readily adaptable to a modem personal computer system (i.e. monitor, computer, keyboard and especially a mouse or other pointing device). The floppy desk cleverly interfaces with today's modern personal computer systems and provides economy and comfort in a simple design. It incorporates a single plane work surface and computer support into a reclining upper assembly that maintains the relative orientation of the operator with the computer system components.

BRIEF SUMMARY OF THE INVENTION

Over the past several years personal computers and input devices have advanced significantly, with no notable progress made in computer furniture. This lack of computer furniture development has led most operators to use a standard desk and chair, the comfort level of this arrangement leaves a lot to be desired. In particular with the advent of the internet and millions of people surfing the net, a need exists for a comfortable and economical personal computer desk for home, office, school, and or dorm room use. The present embodiment, the floppy desk, solves these problems by providing a cost effective and comfortable solution.

The floppy desk is anthropometrically designed to proportions that provide maximum operator comfort. It has an upper assembly consisting of a tubular frame, a seat, an adjustable back and headrest, a computer support, a foot platform, and a single plane work surface that supports a monitor, a keyboard, and includes a sidearm support area for a pointing device. A support base with a footprint of sufficient area is used to support the upper assembly and maintain the center of gravity while in the horizontal and reclined positions.

The most important feature of the floppy desk is its ability to recline while still allowing the operator to maintain his or her orientation relative to the computer, monitor, keyboard and mouse. When the operator takes the seated position his or her offset weight causes the upper assembly to pivot into the reclined positions. The pivot point of the upper assembly is located so that a lightweight operator is sufficient to pivot the entire upper assembly. An adjustment knob is used to vary the angle of the upper assembly from horizontal to the maximum recline. As the upper assembly reclines it is damped by a shock absorber or gas spring until it reaches the stop on the adjustment knob. When the operator vacates the seat the offset weight of the upper assembly, monitor and computer return it to the horizontal position.

Adjustable retaining clips are used to secure monitors and keyboards of different sizes to the singe plane work surface.

To retain the pointing device on the work surface during reclined operation a small amount of cord is secured by a clip to the edge of the work surface.

The floppy desk can be easily manufactured for either left or right hand operators, with the side arm support tube and work surface situated on the side of the operators preferred hand.

DETAILED DESCRIPTION OF THE INVENTION

Figure 1:
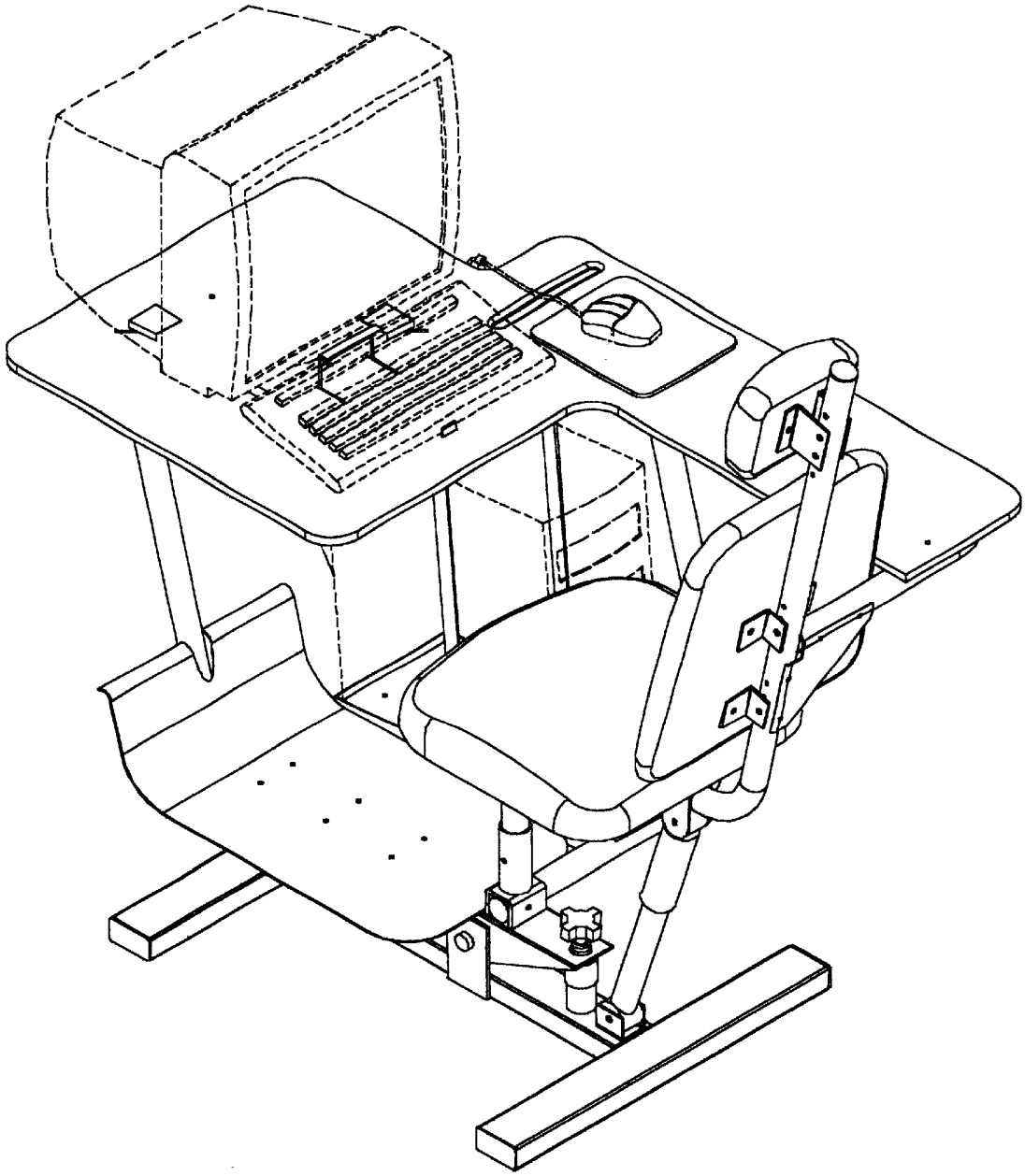
FIG. 1 is an isometric view of the floppy desk.
Figure 2:
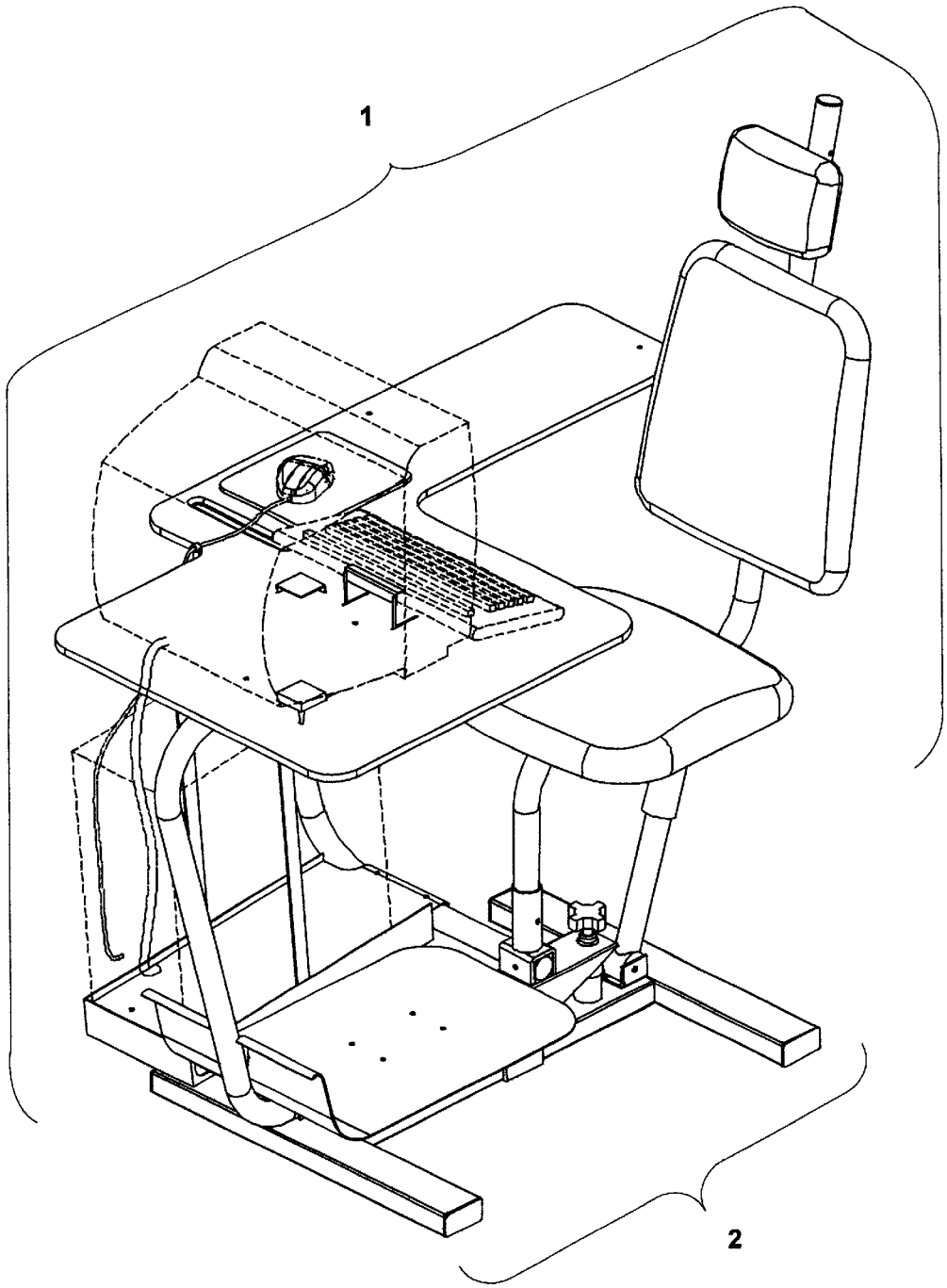
FIG. 2 is an isometric view of the floppy desk showing the upper assembly and support base.
Figure 3:
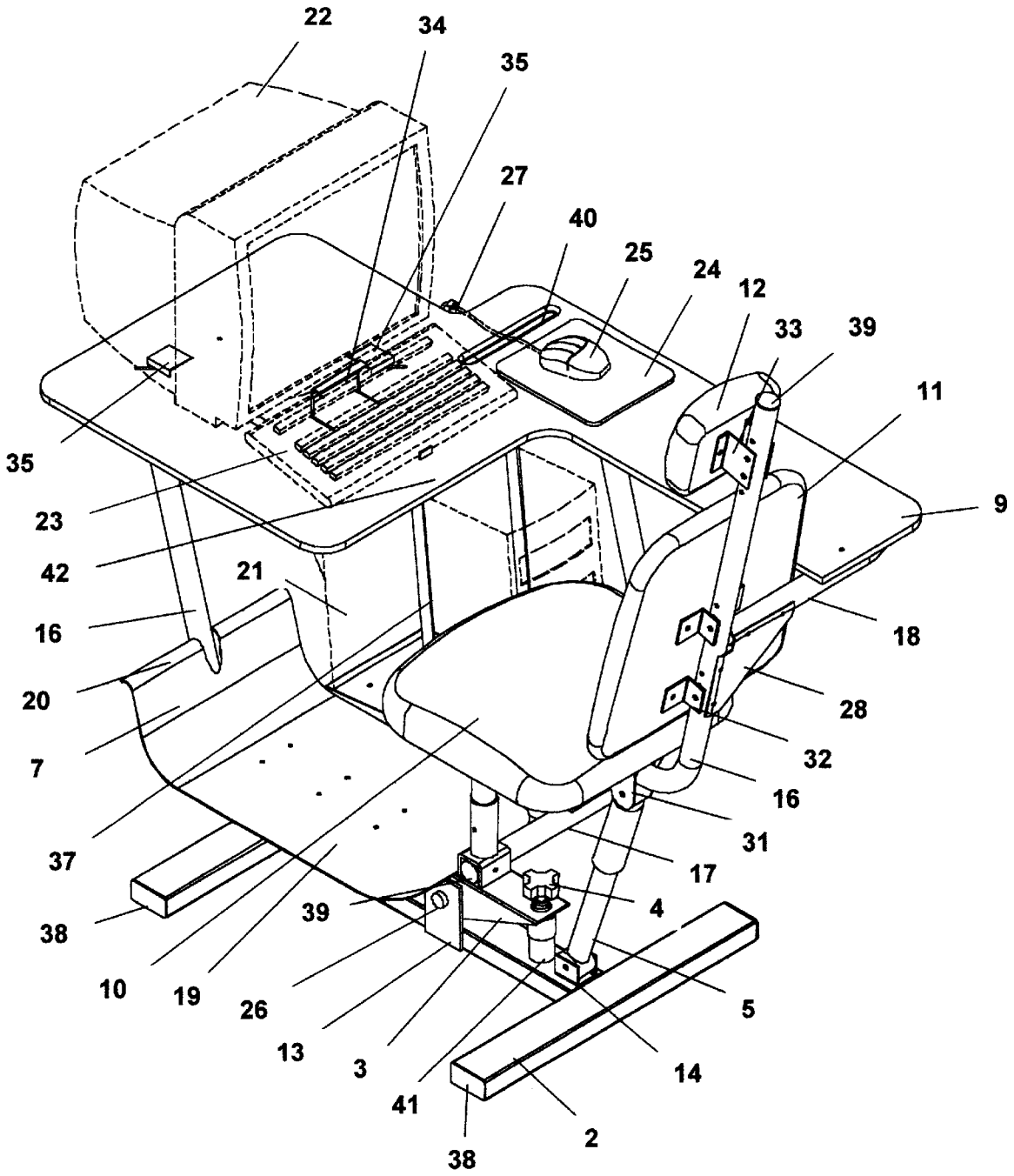
FIG. 3 is an isometric view of the floppy desk shows components of the upper assembly and support base.
Figure 9:
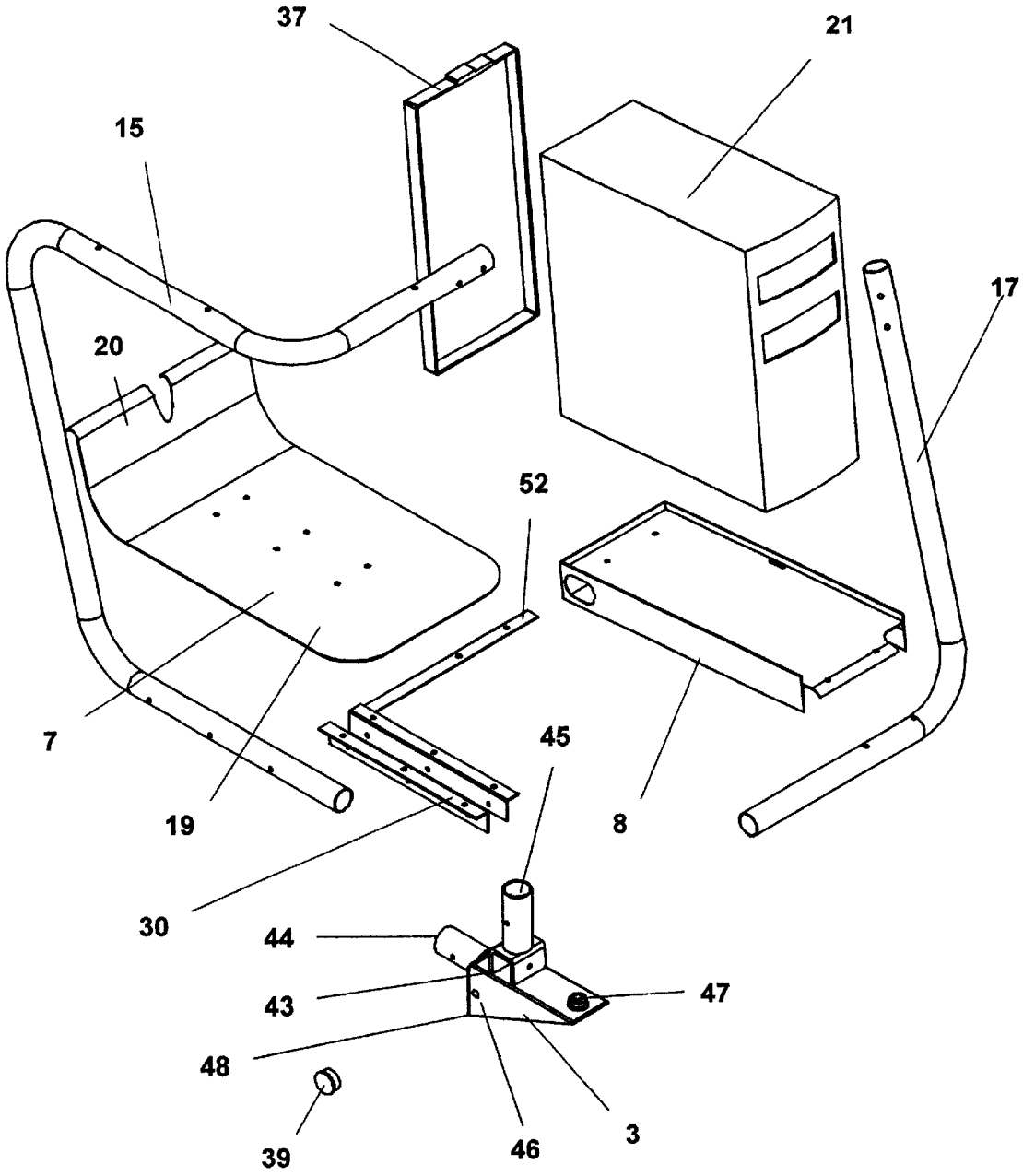
FIG. 9 is a detail view of the foot platform assembly and computer support.
Figure 10:
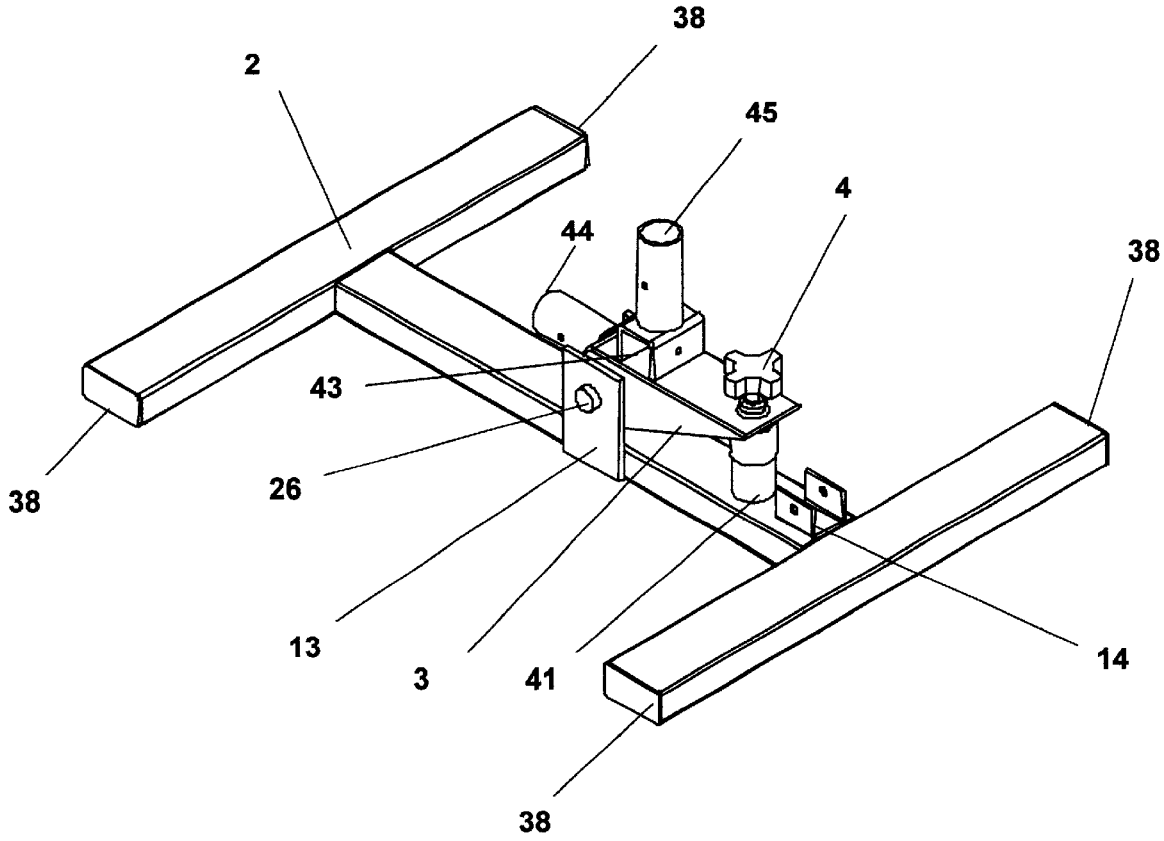
FIG. 10 is an isometric view of the support base.

Refer now to the drawings and in particular FIG. 2, the floppy desk consists of an upper assembly 1 and a support base 2. The upper assembly 1 is broken down into a tubular frame (FIG. 6), a seat 10 with back Hand headrests 12 (FIG. 7), a single plane work surface 9 (FIG. 8), a foot platform 7, and computer support 8 (FIG. 9). The support base 2 is constructed of rectangular tubing with (2) integral brackets 13, 14 (FIG. 10). The first bracket 13 supports the upper assembly 1 through a yoke 3 and pivot pin 26. The second bracket 14 forms the lower attachment point for a shock absorber or gas spring 5 (FIGS. 3 and 10).

Figure 6:
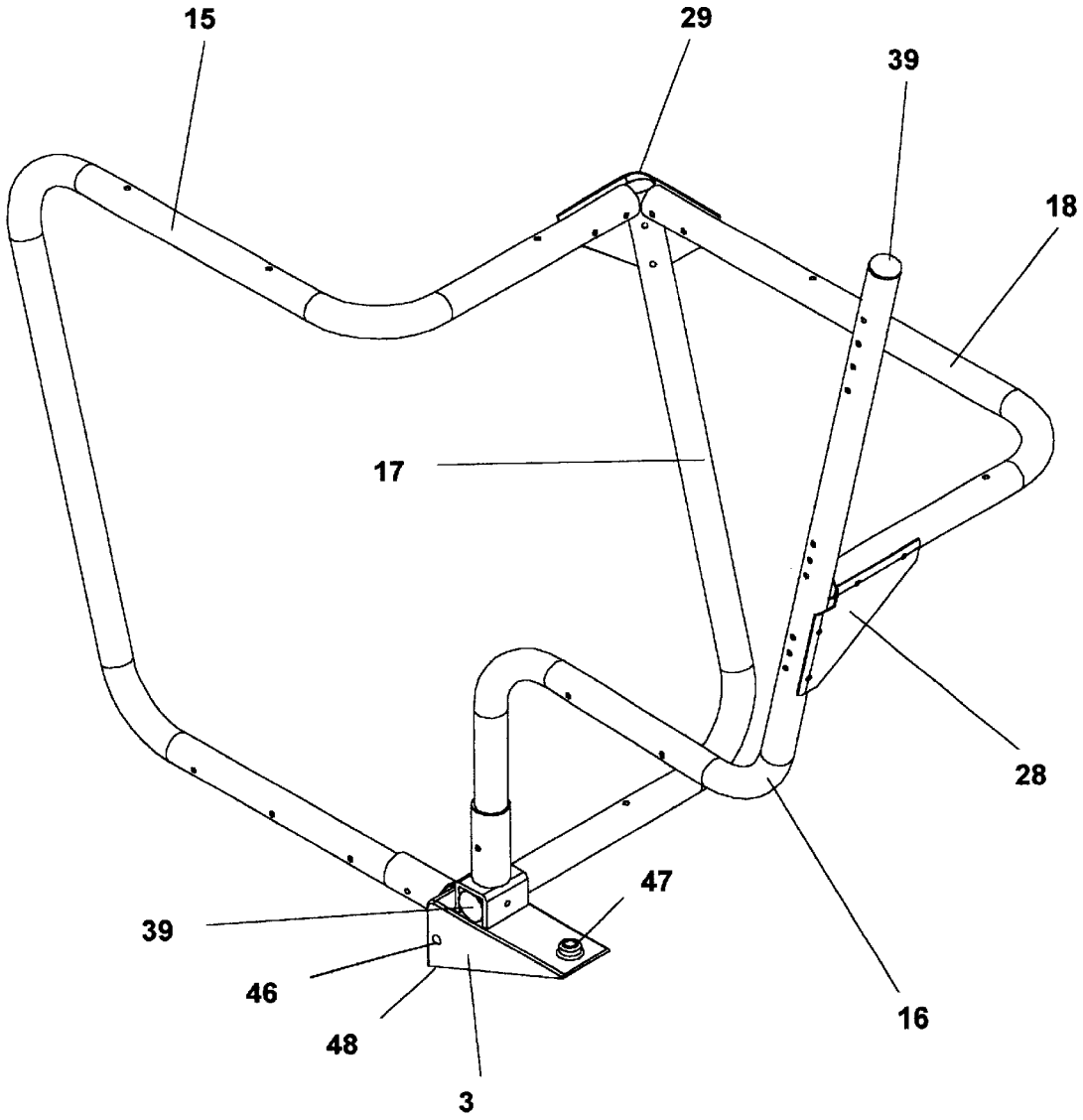
FIG. 6 is a detail view of the tubular frame assembly.

The tubular frame shown in FIG. 6 is composed of a front support tube 15, a seat tube 16, a vertical support tube 17, a side arm support tube 18, a yoke 3, a comer bracket 28, and a tee bracket 29. The front support tube 15, the seat tube 16, and the vertical support tube 17 are mated together by inserting each of them into the sockets of the yoke 3 and securing with screws and nuts. A round plastic cap 39 is used to hide the open end of the vertical support tube 17. All tubes are predrilled for simple bracketed assembly. The side arm support tube 18 and the seat tube 16 are secured to each other with screws and nuts, via a corner bracket 28. The side arm support tube 18, the front support tube 15, and the vertical support tube 17 are secured to each other with screws and nuts, via a tee bracket 29. The tubes 15, 16, 17, 18 are composed of metal or composite plastic of sufficient thickness to minimize deflection. The comer bracket 28 and tee bracket 29 are formed from sheet metal of sufficient thickness to provide rigid connections.

Figure 11:
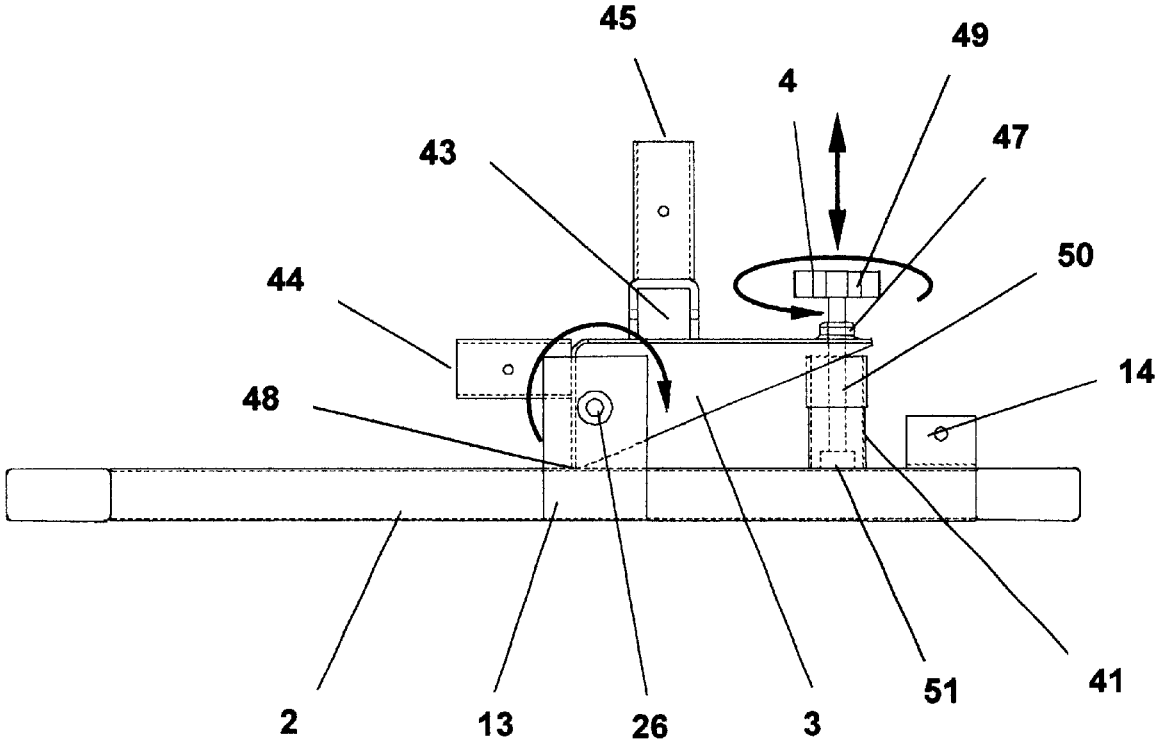
FIG. 11 is a side view of the yoke, base and recline adjustment knob assembly.

FIG. 9 shows the yoke 3, which is either cast or fabricated. It has (3) sockets 43, 44, 45 to accept the tubular frame members 15, 16, 17. The yoke 3 has a cross section of sufficient inertia to provide a rigid support, from which the upper assembly 1 is pivoted with a minimum of deflection. A lateral hole 46 through the yoke 3 provides a journal for the pivot pin 26 of the upper assembly 1 (FIGS. 9 and 10). The yoke 3 also has a threaded hole 47 for the adjustment knob 4. A protruding abutment of material opposite the adjustment knob 4 acts as the yoke stop 48 when the upper assembly returns to its horizontal position (FIG. 11).

Figure 12:
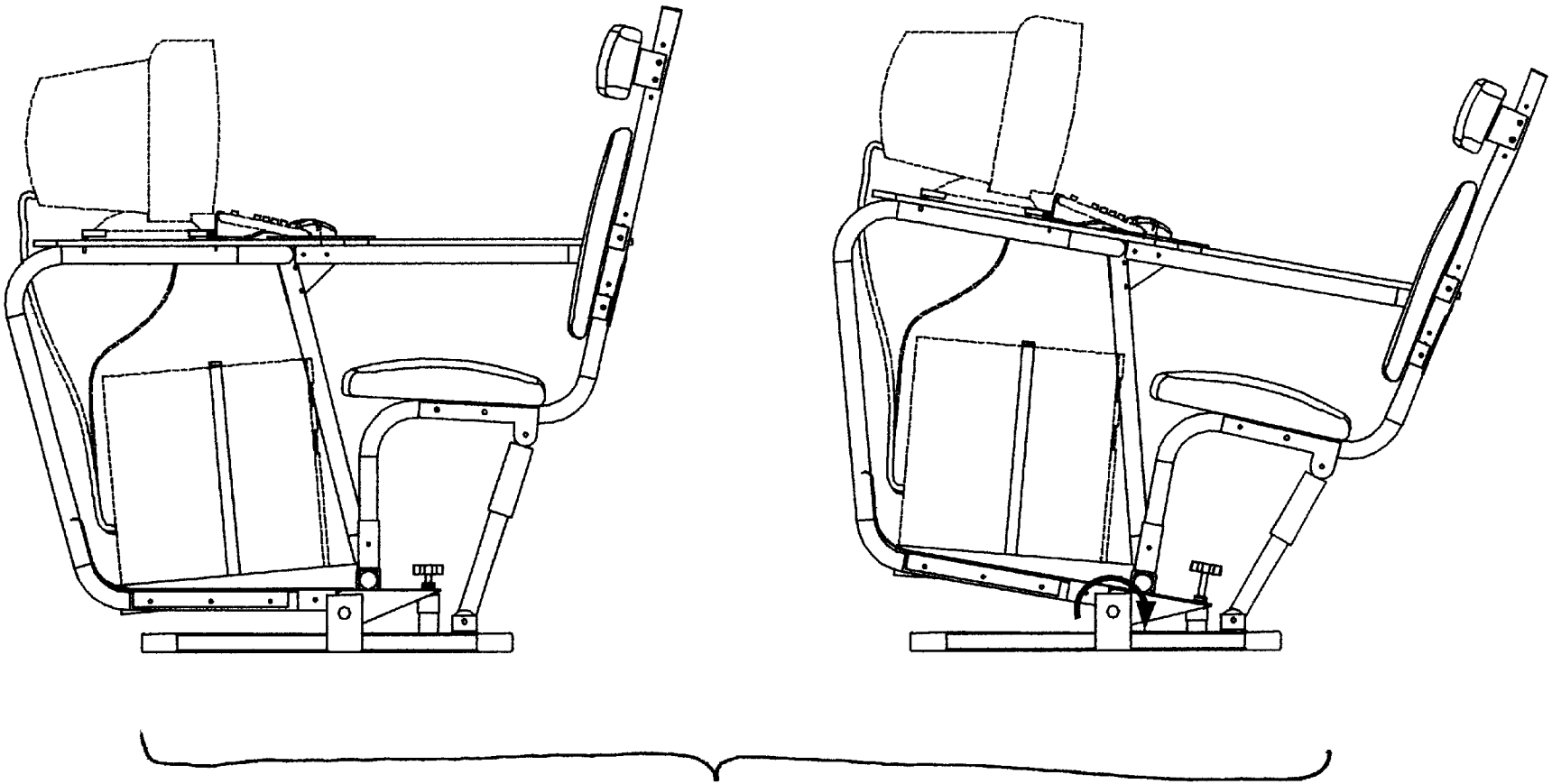
FIG. 12 is a side view of the floppy desk in horizontal and reclined positions. (For clarity fasteners are excluded from FIGS. 1–12).
Figure 13:
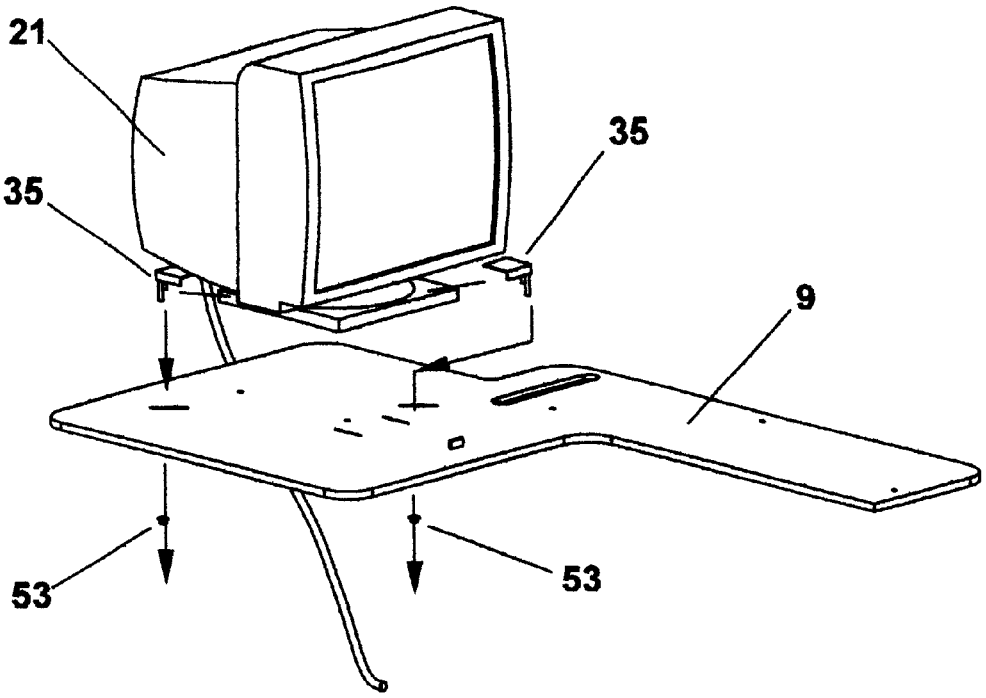
FIG. 13 is an isometric view of the monitor attaching means.
Figure 14:
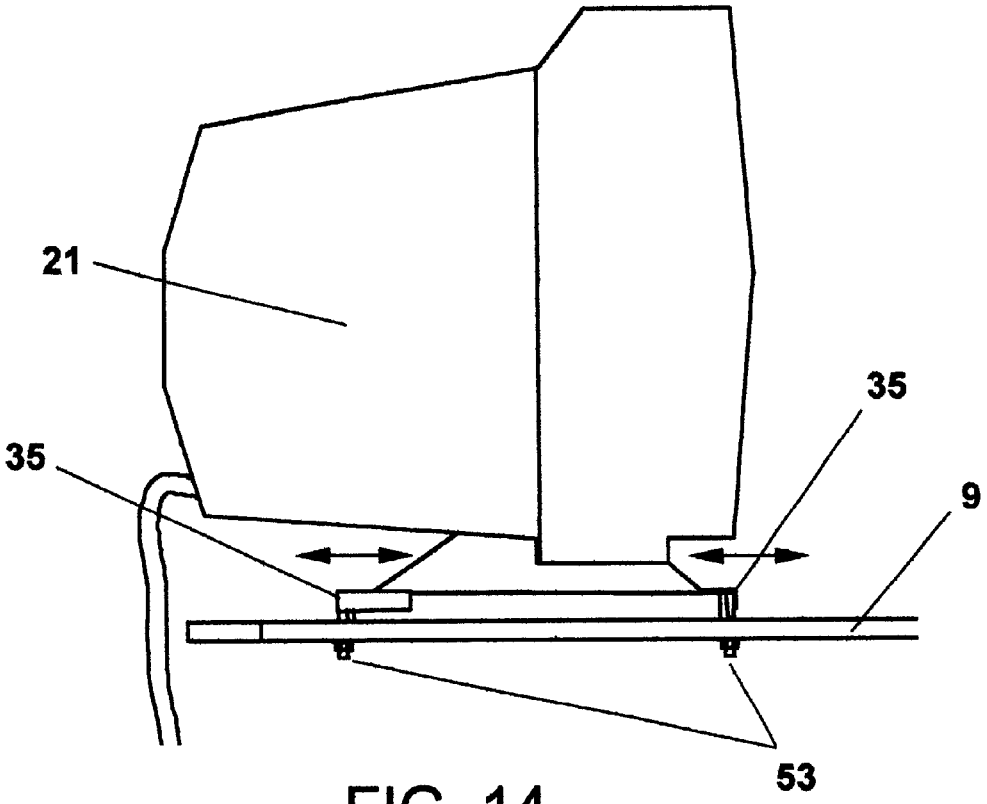
FIG. 14 is a side view of the monitor attachment.
Figure 15:
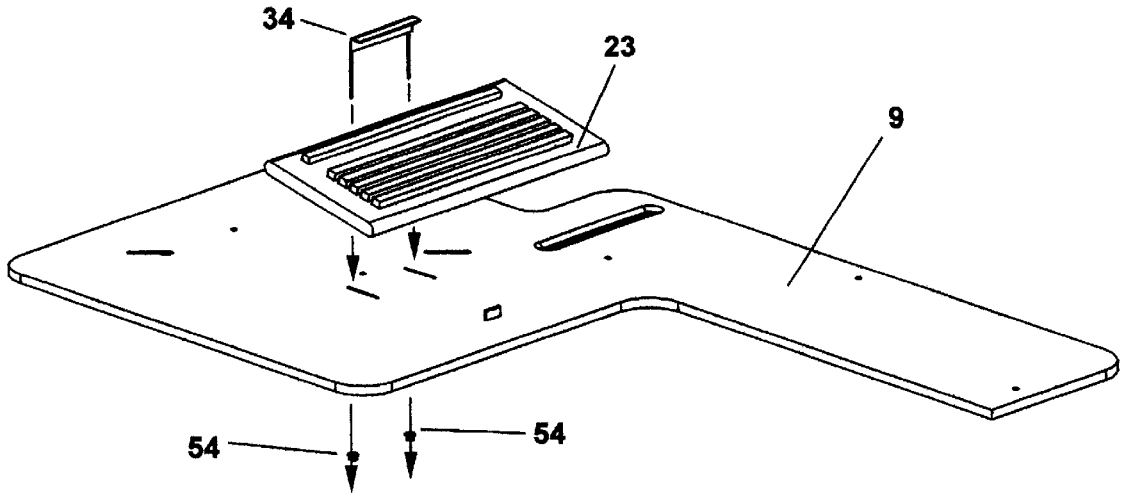
FIG. 15 is an isometric view of the keyboard attaching means.
Figure 16:
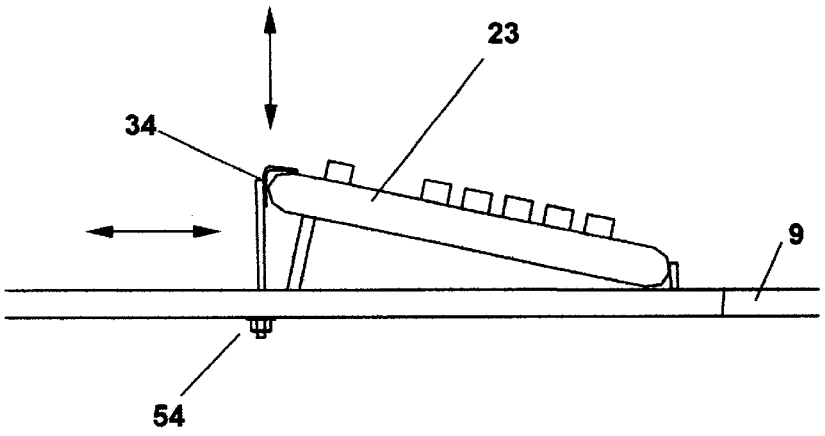
FIG. 16 is a side view of the keyboard attachment.

The adjustment knob 4 consists of a plastic knob 49 on a threaded shaft 50 with a rubber bumper 51 attached to the opposite end. The recline angle of the upper assembly 1 is preset by screwing the adjustment knob 4 up or down prior to taking the seated position. With the adjustment knob 4 screwed down completely and the yoke stop 48 firmly up against the support base 2, the upper assembly 1 will remain horizontal (FIGS. 3, 11, and 12). The rubber bumper 51 provides a cushion for the upper assembly 1 as it reaches its preset recline angle. To eliminate a pinch point a plastic protective sleeve 41 surrounds the rubber bumper 51 portion of the adjustment knob 4.

Figure 4:
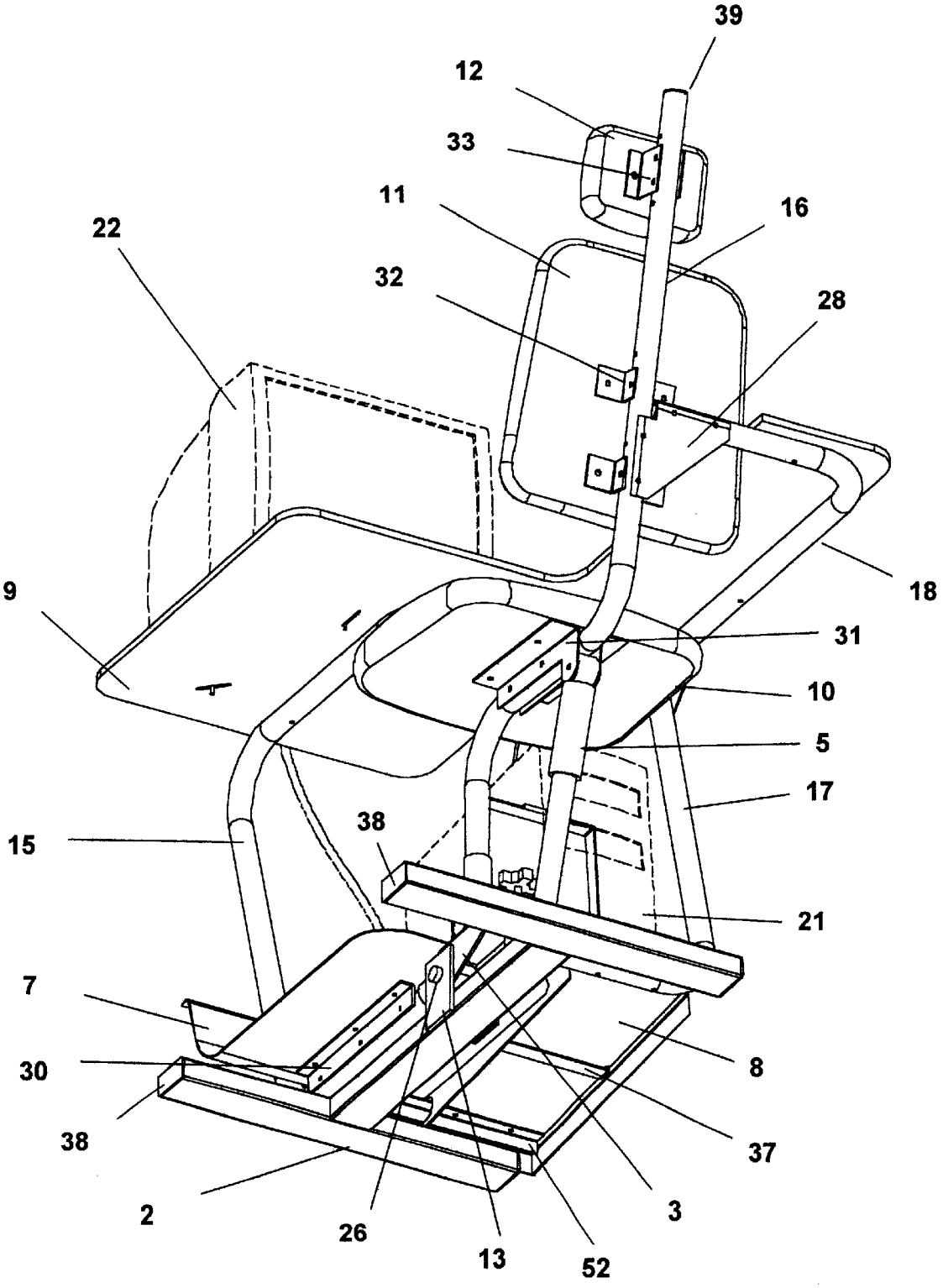
FIG. 4 is an isometric view showing the components of the back and under side of the floppy desk.
Figure 7:
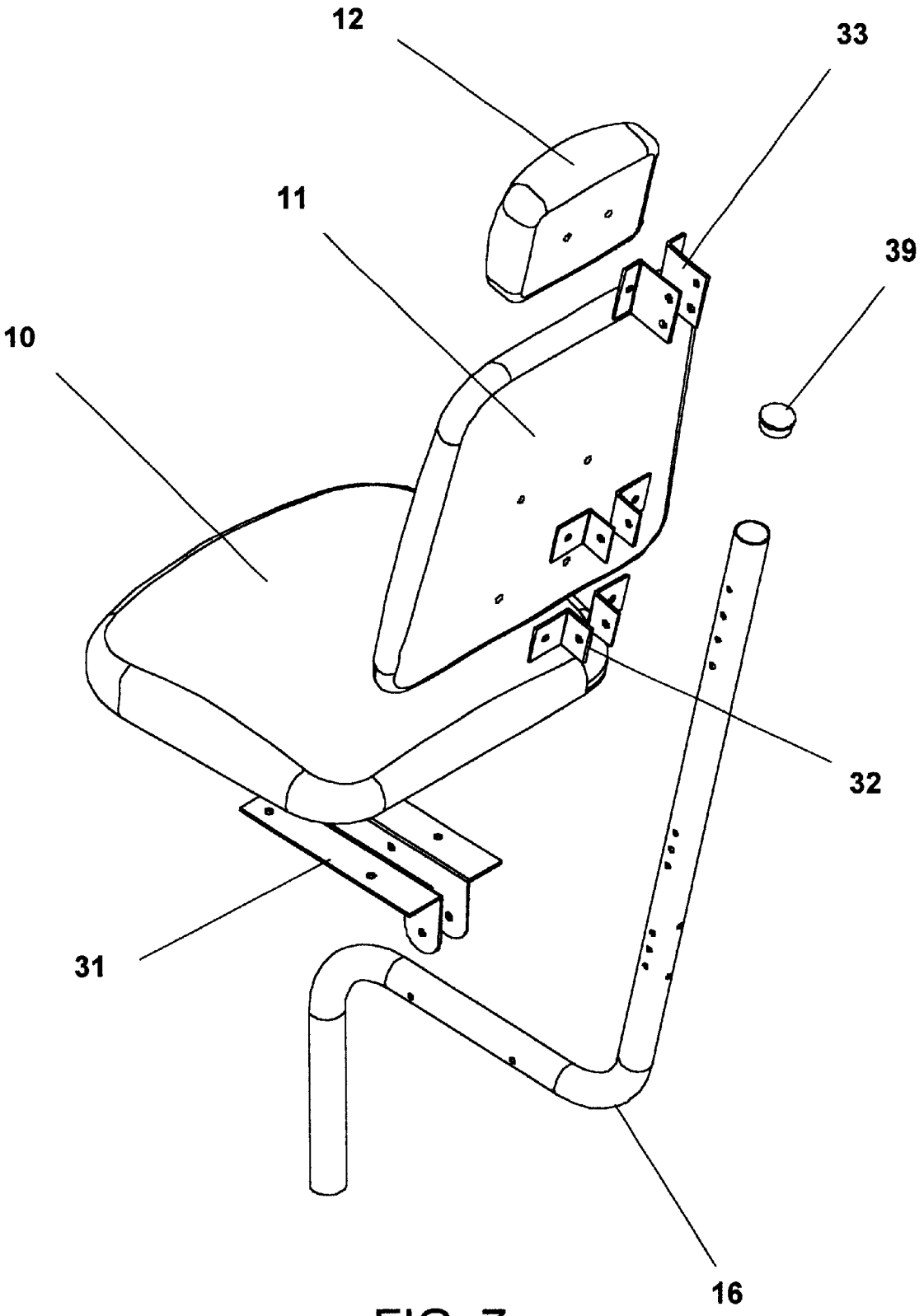
FIG. 7 is a detail view of the seat, back, and headrest attachments.

FIG. 7 shows the seat 10, back 11, and headrest 12. They are manufactured of a rigid backing (such as plywood), thick foam cushions and heavy fabric coverings for durability and operator comfort. The seat 10, back 11, and headrest 12 provide a chair for the average of the $95^{th}$ percentile of males and females. It is mounted to the seat tube 16 by a seat bracket 31 and secured with screws and nuts. The seat bracket 31 also serves as an attachment point for the upper end of the shock absorber or gas spring 5 (FIG. 4). To accommodate operators of different upper body dimensions the seat tube 16 has multiple holes for varying the back 11 and headrest 12 positions (FIG. 7). The back 11 and headrests 12 are mounted to the seat tube 16 via brackets 32, 33 and secured with screws and nuts. A round plastic cap 39 hides the open end of the seat tube 16.

The foot platform 7 shown in FIG. 9 is manufactured of fabricated sheet metal or injection molded plastic and provides a foot support for the operator. It is mounted to the front support tube 15 via a bracket 30, and secured with screws and nuts. The shape of the foot platform provides a horizontal foot surface 19 for the operator while sitting erect and a rolled edge 20 for a foot rest while in the reclined position. The foot platform 7 is rigid enough to support the operator's weight during mounting or dismounting (FIG. 3).

The computer support 8 shown in FIG. 9 is manufactured of fabricated sheet metal or injected molded plastic. It is rigid enough to support a large personal computer 21 without severe deflections or vibrations. One end is mounted to the vertical support tube 17 and at the other to the cantilevered member 52, the cantilevered member being attached to the foot platform bracket 30 (FIGS. 4 and 9). The computer support 8 and cantilever member 52 are secured with screws and nuts. The computer support is mounted at a slight incline to provide easy operator access and to prevent disks or CD's from falling out of their drives during reclined operation (FIG. 12). An adjustable cinch strap 37 is provided to hold the computer 21 in place during reclined operation (FIGS. 3 and 9).

The support base 2 as shown in FIGS. 2, 3, and 10 is fabricated of rectangular metal tubing. The support base 2 provides a rigid support for the upper assembly 1, computer 21, monitor 22, keyboard 23, pointing device 25, and a human operator. As mentioned earlier the support base 2 has (2) integral brackets, the first 13 provides the pivot point for the yoke 3 of the upper assembly 1, the second 14 acts as a lower attachment point for a shock absorber or gas spring 5. To provide an aesthetic appearance plastic caps 38 are provided to cover the open ends of the rectangular tubes.

A hydraulic shock absorber or gas spring 5 is provided to dampen the rotation of the upper assembly 1 as it reclines to its preset position (FIGS. 3 and 12). It also dampens the return motion of the upper assembly 1 when the operator vacates the seat 10.

Figure 8:
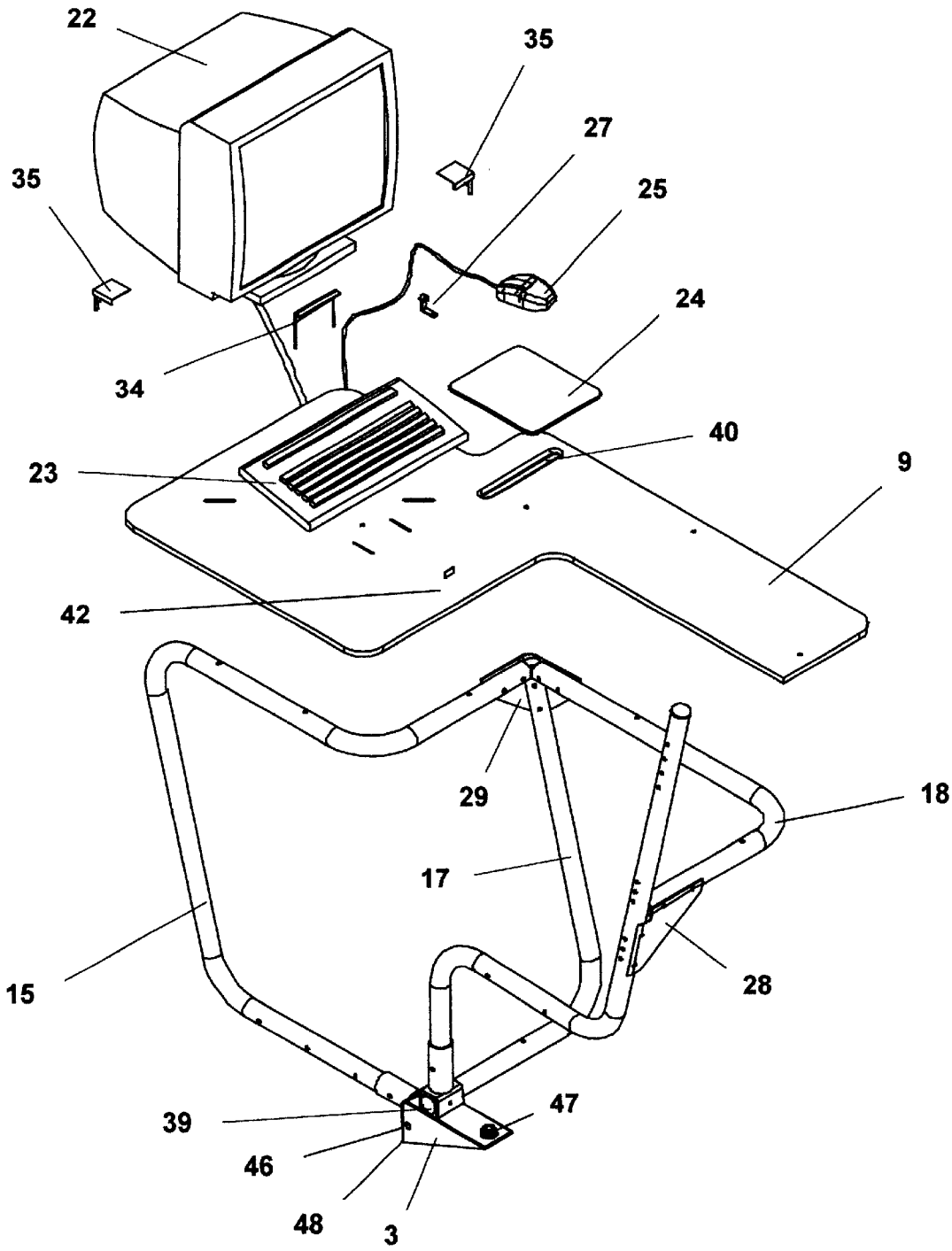
FIG. 8 is a detail view of the single plane work surface, monitor and keyboard clips.

The single plane work surface 9 as shown in FIG. 8 is composed of wood or injection molded plastic. It has predrilled or cast holes for mounting to the tubular frame and is secured with screws and nuts. Retaining clips 34, 35 secure the monitor 22 and keyboard 23 to the single plane work surface 9. The single plane work surface 9 has cut or cast slots that allow the adjustable retaining clips 34, 35 to adapt to different size keyboards 23 and monitors 22 (FIG. 8). In addition to providing a mounting surface, the single plane work surface 9 also provides a portion of the required structural rigidity of the upper assembly 1. The single plane work surface 9 has a small ledge 42 just ahead of the keyboard 23 for wrist support during typing. It also acts as a side arm support area for comfortable positioning of the operator's forearm and hand while using a mouse 25 or other pointing device. The single plane work surface 9 has a cut or molded slot 40 located forward of the pointing device area for writing utensils or miscellaneous items. To prevent the pointing device 25 from falling off the work surface a cord retaining clip 27 is attached to the forward end of the single plane work surface 9 and retains a small amount of pointing device cord (FIG. 3).

Figure 5:
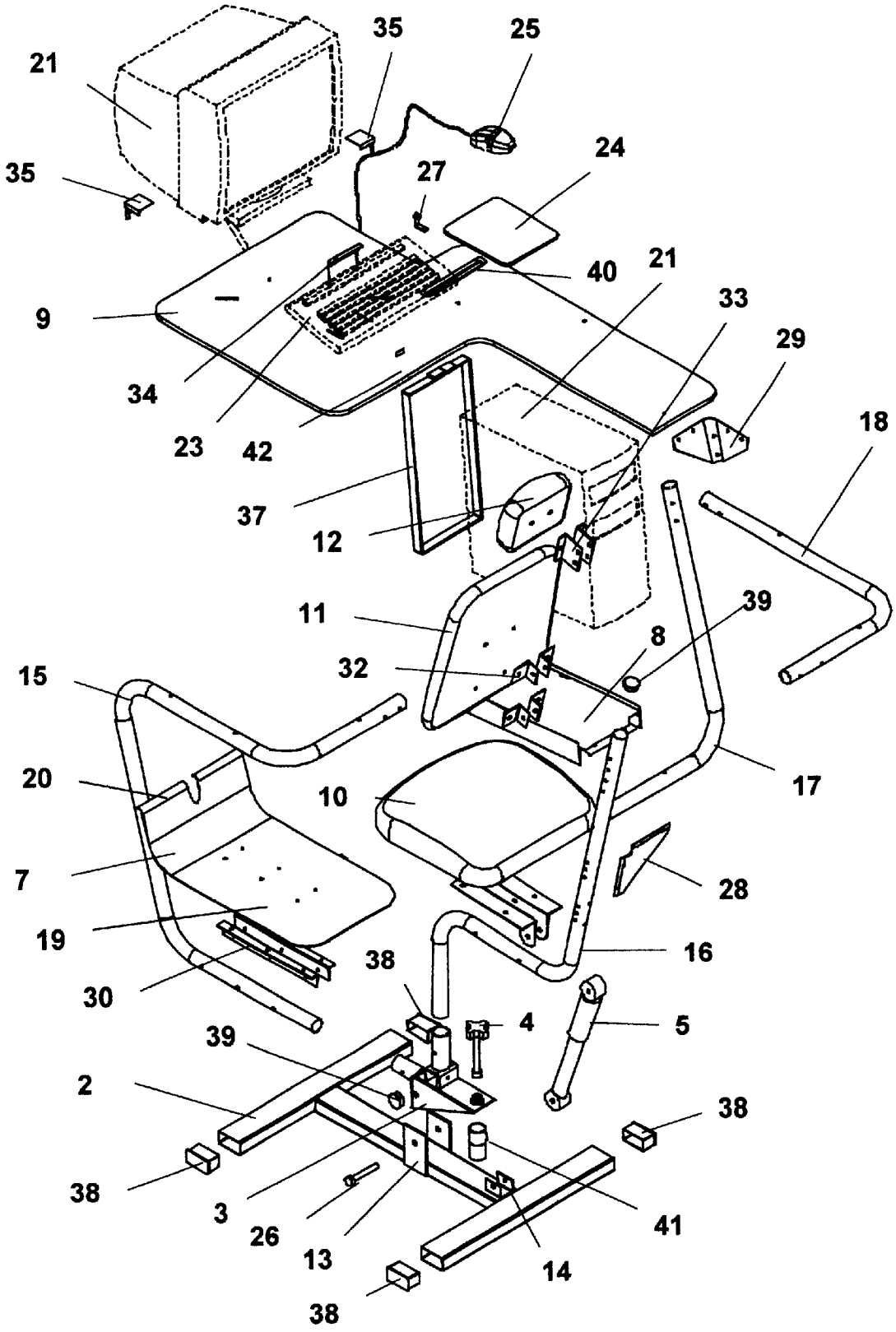
FIG. 5 is an exploded view of the floppy desk showing the relative positions of all components.

With the floppy desk fully assembled, the computer system components are mounted to the upper assembly (FIGS. 3 and 5). The monitor 22 and keyboard 23 are secured to the single plane work surface 9 with threaded adjustable retaining clips 34, 35 that pass through slots in the work surface and are secured by nuts 54 and 53 (FIGS. 13, 14, 15 and 16). The retaining clips 34, 35 adjust to different size monitors 22 and keyboards 23. A cinch strap 37 is wrapped around the computer case and passes through (2) slots in the computer support 8. It is drawn tight to keep the computer 21 from moving during reclined operation. A mouse pad 24 is also provided for use with a mouse.

With all components attached to the floppy desk it is now ready to be used. With the adjustment knob 4 screwed completely down the floppy desk remains horizontal. In the horizontal position it is a useful seating arrangement for classrooms or offices. By unscrewing the adjustment knob 4 and taking the seated position the operators offset weight causes the floppy desk to recline. Reclining provides added comfort during long periods of internet browsing. A quick turn of the adjustment knob is all that is necessary to provide many comfortable positions. When the operator vacates the seat the offset weight of the upper assembly, monitor, and computer causes the floppy desk to return to its horizontal position. FIG. 12 shows the floppy desk in its horizontal and reclined positions. The floppy desk is cost effective, simple to assemble, easy to operate, and provides operator comfort never before seen in a computer desk or workstation.

While the invention has been clearly illustrated, those skilled in the art may make modifications to the structure, arrangement, and proportions of the invention without departing from the principles and scope of the invention. Other variations are possible, for example, if the single plane work-surface were rigid enough, and the tubing sufficiently strengthened, the frame tubes could mate with the single plane work surface in a nearly perpendicular manner, eliminating the cost and weight of the excess tubing. Another variation would be to provide a means of rotation for the entire upper assembly about a vertical axis for optimal positioning. The detailed description and illustrations should not be construed as limiting the scope of the invention. The embodiments of the invention in which exclusive property or privilege is claimed, are defined as follows:

What I claim as my invention is:

1. A computer desk or workstation comprising, in combination:

a) an upper assembly and support base;

b) said upper assembly consisting of a tubular frame having members, a single plane work surface, a seat, with back and head rests for an operator, a recline adjustment knob, a shock absorber, a foot platform, and a computer support surface;

c) a support base consisting of a rigid frame that provides a platform for supporting the upper assembly, an integral attaching means for the upper assembly, and an attachment point for said shock absorber;

d) a yoke that provides a means for mating the members of the tubular frame, a pivot pin journal, and a threaded hole for said recline adjustment knob;

e) a pivot pin that mates the yoke to the support base and provides a means of rotation for the upper assembly;

f) said recline adjustment knob for limiting the angle of recline of the upper assembly;

g) said shock absorber is a gas spring to damp the reclining or return motion of the upper assembly;

h) said tubular frame consisting of a front support tube, seat tube, a vertical support tube, and a side arm support tube, said yoke, and connecting brackets;

i) said single plane work surface attached to the upper portion of the tubular frame, providing a securing means for a monitor, and a keyboard, and includes a side arm area for the operators arm while using a pointing device such as a mouse, track ball, or digitizer;

j) said computer support surface attached to the front and vertical support tubes, and providing a mounting surface for securing a personal computer;

k) said foot platform fixed to the front support tube of the tubular frame providing a foot rest for the operator;

l) said seat is fixed or adjustable and supports the upper legs and buttocks of the operator;

m) said back and head rest is fixed or adjustable and supports the back and head of operators of varying upper body proportions;

n) a clip attached to the front edge of the single plane work surface that retains a small amount of pointing device cord.

2. A computer desk or workstation according to claim 1, wherein said upper assembly pivots relative to said support base.

3. A computer desk or workstation according to claim 1, wherein said support base supports said upper assembly and has a footprint of sufficient area to maintain the center of gravity of the upper assembly while in the horizontal and reclined positions.

4. A computer desk or workstation according to claim 1, wherein said adjustment knob adjusts the angle of recline of the upper assembly from horizontal to a maximum recline angle.

5. A computer desk or workstation according to claim 1, wherein said shock absorber has one end attached to the upper assembly and other to the support base.

6. A computer desk or workstation according to claim 1, wherein said front support tube is attached to the yoke and bent to form the front support for said single plane work surface.

7. A computer desk or workstation according to claim 1, wherein said seat tube is attached to the yoke and bent to form the mounting surface for said seat, adjustable back and head rests; and also acting as a support surface for the side arm support tube and single plane work surface.

8. A computer desk or workstation according to claim 1, wherein said vertical support tube is attached to the yoke that adds rigidity to the side arm and front support tubes and in turn to the single plane work surface.

9. A computer desk or workstation according to claim 1, wherein said side arm support tube is attached to the front and vertical support tubes on one end and to the seat tube at the other end.

10. A computer desk or workstation according to claim 1, wherein said foot platform is attached to the front support tube, that provides foot placement for erect, or reclined seating.

11. A computer desk or workstation according to claim 1, wherein said computer support is strong enough to support and secure the weight of a personal computer.

12. A computer desk or workstation according to claim 11, wherein said computer support is mounted at an angle to the horizontal which allows the operator easy access to the disk drives located at the front of the computer.

13. A computer desk or workstation according to claim 1, wherein said single plane work surface provides securing means for a monitor, keyboard and mouse pad, and also acts as a side arm support area for the operator by supporting the forearm and hand for a mouse or other pointing device (i.e. mouse, track ball or digitizer).

14. A computer desk or workstation according to claim 13, wherein said securing means are adjustable.

15. A computer desk or workstation according to claim 1, having a fixed or adjustable attaching means for securing the seat to the seat tube.

16. A computer desk or workstation according to claim 1, having a fixed or adjustable attaching means for securing the back and head rest to the seat tube.

17. A computer desk or workstation according to claim 1, wherein said yoke is located relative to the center of gravity of the upper assembly, so that when the operator is in the seated position, his or her weight will cause the upper assembly to recline.

18. A computer desk or workstation according to claim 1, wherein said yoke is located relative to the center of gravity of the upper assembly, so that when the operator vacates the seat, the offset weight of the monitor and computer returns the upper assembly to its horizontal position.

19. A computer desk or workstation according to claim 1, having a means for attaching a short length of pointing device cord to the work surface to prevent the pointing device from falling off of the work surface.

* * * * *